US008172956B2

(12) United States Patent
Unoki et al.

(10) Patent No.: US 8,172,956 B2
(45) Date of Patent: May 8, 2012

(54) SINTERED SOFT MAGNETIC POWDER MOLDED BODY

(75) Inventors: Kenichi Unoki, Aizuwakamatsu (JP); Shoichi Yamasaki, Aizuwakamatsu (JP); Yuji Soda, Utsunomiya (JP); Masakatsu Fukuda, Tokyo (JP)

(73) Assignee: Mitsubishi Steel Mfg. Co., Ltd., Tokyo (JP)

( * ) Notice: Subject to any disclaimer, the term of this patent is extended or adjusted under 35 U.S.C. 154(b) by 160 days.

(21) Appl. No.: 12/601,206

(22) PCT Filed: May 14, 2008

(86) PCT No.: PCT/JP2008/058855

§ 371 (c)(1),
(2), (4) Date: Jan. 19, 2010

(87) PCT Pub. No.: WO2008/143091

PCT Pub. Date: Nov. 27, 2008

(65) Prior Publication Data

US 2010/0162851 A1 Jul. 1, 2010

(30) Foreign Application Priority Data

May 21, 2007 (JP) ..... 2007-134488

(51) Int. Cl.
*H01F 1/147* (2006.01)
*H01F 1/22* (2006.01)

(52) U.S. Cl. ..... 148/104; 75/246; 419/10; 148/306

(58) Field of Classification Search ..... None
See application file for complete search history.

(56) References Cited

U.S. PATENT DOCUMENTS

| | | | | |
|---|---|---|---|---|
| 4,773,948 | A * | 9/1988 | Nakaoka et al. | 148/111 |
| 5,443,787 | A * | 8/1995 | Mori et al. | 419/32 |
| 6,126,894 | A * | 10/2000 | Moxson | 419/2 |
| 6,432,159 | B1 * | 8/2002 | Saito et al. | 75/255 |
| 6,485,579 | B1 * | 11/2002 | Nillius et al. | 148/104 |
| 2003/0070508 | A1 | 4/2003 | Ozaki et al. | |
| 2004/0161600 | A1 * | 8/2004 | Igarashi et al. | 428/328 |

FOREIGN PATENT DOCUMENTS

| | | | |
|---|---|---|---|
| CN | 1862720 | A | 11/2006 |
| JP | 49-15684 | | 4/1974 |
| JP | 58171555 | A | 10/1983 |
| JP | 63-307245 | * | 12/1988 |
| JP | 7076758 | A | 3/1995 |
| JP | 7238352 | A | 9/1995 |
| JP | 11293420 | A | 10/1999 |

(Continued)

OTHER PUBLICATIONS

Machine Transaltion of Japanese Patent Document 2005-060830, (JP 2005-060830 Published Mar. 2005).*

(Continued)

*Primary Examiner* — John Sheehan
(74) *Attorney, Agent, or Firm* — Marshall, Gerstein & Borun LLP

(57) ABSTRACT

A sintered soft magnetic powder molded body having a composition containing Fe, 44 to 50% by mass of Ni and 2 to 6% by mass of Si, or a composition containing Fe and 2 to 6% by mass of Si, wherein the Si is unevenly distributed among particles, is provided.

20 Claims, 1 Drawing Sheet

FOREIGN PATENT DOCUMENTS

| | | | |
|---|---|---|---|
| JP | 2002317204 | A | 10/2002 |
| JP | 2005060830 | A | 3/2005 |

OTHER PUBLICATIONS

International Search Report for PCT/JP2008/058855 dated Aug. 19, 2008.

Hitachi Powder Metallurgy Technical Report No. 3:28-32 (2004).

Hitachi Powder Metallurgy Technical Report No. 5:27-30 (2006).

Tohoku Steel Co., Ltd., produt information (electromagnetic stainless steel), URL:http://www.tohokusteel.com/pages/tokushu_zail.htm, Mar. 13, 2007.

English-language translation of First Office Action for Japanese Application No. 200880016716.3, dated Nov. 2, 2011.

* cited by examiner

SINTERED SOFT MAGNETIC POWDER MOLDED BODY

TECHNICAL FIELD

The present invention relates to a sintered soft magnetic powder molded body using a soft magnetic powder.

BACKGROUND ART

Until now, stainless materials made of a melted stainless have been widely known as a sintered electromagnetic stainless material obtained by sintering. Electromagnetic stainless materials are used, for example, as magnetic parts such as electromagnetic valves, injectors for injecting fuels and various actuators.

Recently, frequency during use and higher harmonic wave component for such magnetic parts have been increased. In accordance with this, for example, loss of electric power and generation of heat due to eddy current generated when alternate current is applied to an iron core having a coil wound around the core tend to increase. Furthermore, hysteresis loss included in iron loss, i.e., generation of heat for the hysteresis that is shown when the magnetic area of the iron core changes the direction of the magnetic field by alternating magnetic field is also not negligible.

As a technique relating to the above, a sintered electromagnetic stainless material containing Si together with Fe—Cr has been suggested. For example, a solid metal made of melted materials including Fe-13Cr-2Si as a main component, and a sintered electromagnetic stainless material having a composition of Fe-6.5Cr-(1.0 to 3.0)Si containing 1 to 3% by mass of Si are disclosed (see, for example, Patent Documents 1 and 2 and Non-patent Documents 1 and 2), and many of which are constituted by using chromium (Cr) as a main component. Furthermore, a technique in which a mixed powder obtained by mixing a Si powder with a Fe powder and the like is pressed to form into a predetermined shape and thereafter sintered is disclosed (see, for example, Non-Patent Document 3).

Meanwhile, in the case of a solid metal made of melted materials, it is necessary to perform processing such as cutting in order to obtain a desired shape and machine processing is inevitable, which is not advantageous for the steps. Therefore, a method in which a formed product having approximately a desired shape is directly obtained using a metal powder in order to readily obtain a desired shape in a short time period while decreasing mechanical processing (near net shape in which molding is carried out by powder metallurgical method) has been widely carried out.

Patent Document 1: Japanese Patent Application Laid-Open (JP-A) No. 7-76758

Patent Document 2: JP-A No. 7-238352

Non-Patent Document 1: Hitachi Powder Metallurgy Technical Report No. 5 (2006), p. 27 to 30

Non-Patent Document 2: Tohoku Steel Co., Ltd., product information (electromagnetic stainless steel), of record in the US Patent and Trademark Office prosecution history of U.S. Ser. No. 12/601,206 filed May 14, 2008.

Non-Patent Document 3: Hitachi Powder Metallurgy Technical Report No. 3 (2004), p. 28 to 32

DISCLOSURE OF THE INVENTION

Problem to be Solved by the Invention

However, in the above-mentioned techniques and sintered electromagnetic stainless materials, the electric specific resistance of the obtained electromagnetic stainless material is about 100 μΩ·cm. Under a recent circumstance in which frequency during use and higher harmonic wave component of magnetic parts have been increased, generation of heat due to generated eddy current may not be suppressed, and higher specific resistance is desired.

Furthermore, the electric power loss that is lost during alternate magnetization, mainly alternate magnetic property (iron loss), is insufficient, and further improvement is demanded.

The present invention has been made in view of the above-mentioned circumstance. And a sintered soft magnetic powder molded body having high specific resistance and excellent alternate current magnetic property, i.e., having low iron loss, is required.

Means for Solving the Problem

A constitution in which Si that corresponds to 2 to 6% by mass of whole of a metal composition including Fe and Ni as main components is disposed among particles of metal particles so that Si has a higher concentration among the particles than that in the metal particles, is effective for improving specific resistance and decreasing iron loss while maintaining molding property. The invention has been achieved based on that finding.

The specific means for achieving the problems are as follows.

<1> A sintered soft magnetic powder molded body including a composition containing Fe, 44 to 50% by mass of Ni and 2 to 6% by mass of Si, wherein the Si is unevenly distributed among particles.

<2> The sintered soft magnetic powder molded body of the <1>, which is prepared by mixing a metal powder including at least Fe and Ni with an Si powder having an average particle diameter of from 1/10 to 1/100 of the average particle diameter of the metal powder, and molding and sintering using the obtained mixture.

<3> The sintered soft magnetic powder molded body of the <2>, wherein the metal powder contains Fe, 44 to 53.2% by mass of Ni and less than 6% by mass of Si.

<4> A sintered soft magnetic powder molded body including a composition containing Fe and 2 to 6% by mass of Si, wherein the Si is unevenly distributed among particles.

<5> The sintered soft magnetic powder molded body of the <4>, which further contains 0.001 to 0.1% by mass of P.

<6> The sintered soft magnetic powder molded body of the <4> or <5>, which is prepared by mixing a metal powder containing at least Fe and a Si powder having an average particle diameter of from 1/10 to 1/100 of the average particle diameter of the metal powder, and molding and sintering using the obtained mixture.

<7> The sintered soft magnetic powder molded body of the <6>, wherein the metal powder is a metal powder containing 94 to 100% by mass of Fe and less than 6% by mass of Si.

<8> The sintered soft magnetic powder molded body of the <7>, wherein the metal powder further contains 0.001 to 0.1% by mass of P.

<9> The sintered soft magnetic powder molded body of any one of the <1> to <8>, wherein the concentration of Si among the particles is higher than the concentration of Si other than among the particles.

<10> The sintered soft magnetic powder molded body of any one of the <2>, <3>, and <6> to <9>, wherein the metal powder is an atomized powder.

<11> The sintered soft magnetic powder molded body of any one of the <1> to <3> and <9> to <10>, wherein Ni content is 48 to 50% by mass and Si content is 3 to 4% by mass.

<12> The sintered soft magnetic powder molded body of any one of the <4> to <10>, wherein Si content is 3 to 4% by mass.

<13> The sintered soft magnetic powder molded body of any one of the <2>, <3> and <6> to <12>, wherein the average particle diameter (D50) of the metal powder is from 1 to 300 μm.

<14> The sintered soft magnetic powder molded body of the <10>, wherein the atomized powder is a water-atomized powder.

Effect of the Invention

According to the present invention, a sintered soft magnetic powder molded body having high specific resistance and excellent alternate current magnetic property, i.e., having low iron loss, may be provided.

BEST MODE FOR CARRYING OUT THE INVENTION

Figure 1A:
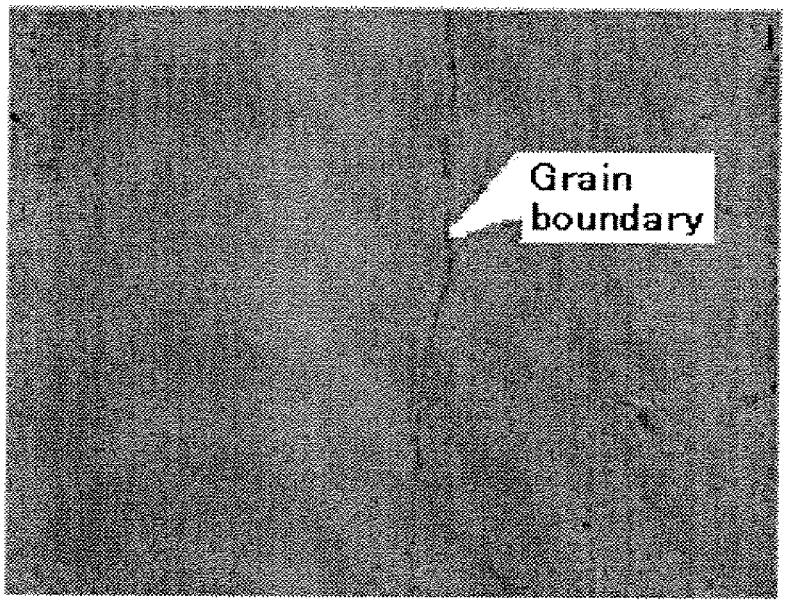
FIG. 1A is a SEM picture showing the inner structure of the sintered product of Example 1.

Hereinafter the sintered soft magnetic powder molded body of the present invention is explained in detail.

The sintered soft magnetic powder molded body of a first aspect of the invention is constituted by containing iron (Fe), 44 to 50% by mass of nickel (Ni) and 2 to 6% by mass of silicon (Si) and unevenly distributing Si among particles. The composition may include inevitable impurities besides the above.

Since the sintered soft magnetic powder molded body of the invention has a constitution in which Cr is not included mainly and Si is unevenly distributed among the particles including Fe and Ni as main components, higher specific resistance may be obtained, and alternate current magnetic property (iron loss) may be dramatically improved.

As used herein, that Si is unevenly distributed among the particles is also briefly referred to as being Si-rich among the particles, which refers to the case when the concentration of Si existing among the metal particles or alloy particles, i.e., among the particles, is higher than the concentration of Si existing in the metal particles or alloy particles (i.e., Si-rich among the particles).

The ratio of Ni that constitutes the sintered soft magnetic powder molded body of the first aspect of the invention is 44 to 50% by mass. When the ratio of Ni exceeds 50% by mass, the saturated magnetic flux density Bs [T (tesla), hereinafter the same] is decreased, and when the ratio of Ni is less than 44% by mass, the maximum relative magnetic permeability μm is decreased, and the saturated magnetic flux density is also decreased. Of these, the preferable range of Ni is 48 to 50% by mass.

The ratio of Si that constitutes the sintered soft magnetic powder molded body of the first aspect is 2 to 6% by mass. When the ratio of Si exceeds 6% by mass, saturated magnetic flux density Bs [T] is decreased and molding becomes difficult to perform (molding property is deteriorated), and when the ratio of Si is less than 2% by mass, the specific resistance ρ[μΩ·cm] is decreased. Of these, the preferable range of Si is 2.5 to 5% by mass, and more preferably 3 to 4% by mass.

Furthermore, in the sintered soft magnetic powder molded body of the first aspect, all or a part of the residual amount of the total mass of the sintered soft magnetic powder molded body other than the above-mentioned Ni and Si may be constituted by Fe.

In the first aspect, when necessary, other metal components may be further included to the extent that the effect of the invention is not deteriorated, as long as each range of the composition for Fe, Ni and Si is satisfied. Other metal components may be optionally selected.

The sintered soft magnetic powder molded body of the first aspect may be obtained by mixing a metal powder including at least Fe and Ni with an Si powder having an average particle diameter of from 1/10 to 1/100 of that of the metal powder, and molding and sintering the obtained mixture. The thus-prepared sintered soft magnetic powder molded body is preferable in view of specific resistance and iron loss. In this case, since the mixed powder is prepared by further adding Si powder to the metal powder including at least Fe and Ni, and molding is carried out by near net shape using the mixed powder, Si may be rich among the particles. Accordingly, the specific resistance of the sintered soft magnetic powder molded body is further increased and the iron loss may be decreased.

In this case, as the "metal powder including at least Fe and Ni", an alloy powder of Fe and Ni, an alloy powder of Fe, Ni and Si, and the like may be used. Specifically, an alloy powder including 44 to 53.2% by mass of Ni, less than 6% by mass of Si, remaining Fe and inevitable impurities may be used, and preferably an alloy powder including 48 to 50% by mass of Ni, less than 6% by mass of Si, remaining Fe and inevitable impurities may be used. For example, a PB permalloy, which is a Fe—Ni soft magnetic alloy, an alloy powder including 48% by mass of Fe, 50% by mass of Ni and 2% by mass of Si, and the like may be preferably used.

The average particle diameter of the above-mentioned Si powder is preferably from 1/10 to 1/100 of the metal powder to be used. By adjusting to this range, the Si powder may be dispersed surely among the particles of the metal powder.

Furthermore, the average particle diameter (D50) of the metal powder is preferably from 1 to 300 μm, and more preferably 10 to 200 μm. When the average particle diameter is 300 μm or less, eddy current loss may be suppressed, and when the average particle diameter is 1 μm or more, hysteresis loss may be decreased.

In the invention, the average particle diameter D50 is a volume average particle diameter when an accumulation is 50% when an accumulated distribution is plotted from the smaller diameter side for the volume of the powder particles.

The sintered soft magnetic powder molded body of a second aspect of the invention is constituted by containing iron (Fe) and 2 to 6% by mass of silicon (Si), and unevenly distributing Si among the particles. The composition may be constituted by containing 0.001 to 0.1% by mass of P besides the above, and may further include inevitable impurities.

Since the sintered soft magnetic powder molded body of the second aspect has a constitution in which Cr is not mainly included and Si is unevenly distributed (i.e., Si-enriched) among the particles including Fe as a main component, higher specific resistance may be obtained, and alternate current magnetic property (iron loss) may be dramatically improved.

In the aspect, that Si is unevenly distributed among the particles refers to a case when the concentration of Si existing among the metal particles or alloy particles, i.e., the concentration of Si existing among the particles, is higher than the concentration of Si existing in the metal particles or alloy particles (i.e., Si is enriched among the particles), as in the first aspect.

The ratio of Si that constitutes the sintered soft magnetic powder molded body of the second aspect of the invention is 2 to 6% by mass. When the ratio of Si exceeds 6% by mass, saturated magnetic flux density Bs [T] is decreased and molding becomes difficult, and when the saturated magnetic flux density is less than 2% by mass, specific resistance ρ[μΩ·cm] is decreased. Of these, a preferable ratio of Si is 2.5 to 5% by mass, and more preferably 3 to 4% by mass.

The ratio of P that constitutes the sintered soft magnetic powder molded body of the second aspect is preferably 0.001 to 0.1% by mass. When the ratio of P is in the range, iron loss becomes finer. In view of making iron loss finer, preferable ratio of P is 0.02 to 0.1% by mass, and more preferably 0.02 to 0.08% by mass.

In the sintered soft magnetic powder molded body of the second aspect, all or a part of the residue other than the above-mentioned Si and P of the whole mass of the sintered soft magnetic powder molded body may be constituted by Fe.

In the second aspect, other metal components may further be included when necessary in the range in which the effect of the invention is not deteriorated, as long as each composition range for Fe, Si and P is satisfied, and other metal component may optionally be selected.

The sintered soft magnetic powder molded body of the second aspect may be prepared by mixing a metal powder including at least Fe and a Si powder having an average particle diameter of from 1/10 to 1/100 of that of the metal powder, and molding and sintering the obtained mixture. The thus-prepared sintered soft magnetic powder molded body is preferable in view of specific resistance and iron loss. In this case, since the mixed powder is prepared by further adding Si to the metal powder including at least Fe, and molding is carried out by near net shape using the mixed powder, Si may be enriched among the particles. Accordingly, the specific resistance of the sintered soft magnetic powder molded body is further increased and the iron loss may be decreased.

In this case, as the "metal powder including at least Fe", a metal powder of only Fe, an alloy powder of Fe and Si, an alloy powder of Fe and P, an alloy powder of Fe, Si and P, and the like may be used. Specifically, an alloy powder including less than 6% by mass of Si, and remaining Fe and inevitable impurities may be preferably used, for example, an alloy powder including 98% by mass of Fe and 2% by mass of Si, and the like may be used.

In the second aspect, the average particle diameter of the Si powder is also from 1/10 to 1/100 of the metal powder to be used, for the same reason as in the first aspect.

Furthermore, the average particle diameter (D50) of the metal powder in the second aspect is preferably from 1 to 300 μm, and more preferably 10 to 200 μm. When the average particle diameter is 300 μm or less, eddy current loss may be suppressed, and when the average particle diameter is 1 μm or more, hysteresis loss may be decreased.

The average particle diameter is as mentioned above.

It is preferable that the sintered soft magnetic powder molded bodies of the first and second aspects are formed by using a powder prepared by atomization (atomized powder) as a metal powder. Since the atomized powder has a relatively round shape and a low segregation, molding may be carried out at a higher density.

The atomized powder is a metal powder that is directly generated from a molten metal by a method in which a solid is not pulverized, but a dissolved metal or alloy (molten metal) is sprayed and cooled quickly, and includes a water atomized powder obtained by spraying a molten metal using high-pressure water, a gas atomized powder obtained by spraying a molten metal using high-pressure gas, and a disc atomized powder obtained by scattering a molten metal using a high-revolution disc.

Of these, a water atomized powder is preferable in view of production cost.

Besides the above, when necessary, a lubricant, a dispersing agent and the like may further be added to the sintered soft magnetic powder molded body of the invention.

The sintered soft magnetic powder molded body of the invention is formed by near net shape using a mixed powder of a metal powder, which is a metal component that constitutes the sintered soft magnetic powder molded body, and a Si powder. By this method, a molded body having a desired shape may be obtained by unevenly distributing more Si among the particles of the metal powder that forms the molded body than in the part other than among the particles, and thus, the specific resistance of the obtained sintered soft magnetic powder molded body becomes higher and the iron loss may be decreased.

Mixing of the metal powder and Si particles may be carried out by arbitrarily selecting a conventionally known method, and may be preferably carried out, for example, by using a V blender, a shaker or the like.

Molding may be carried out by putting a mixture of a metal powder and Si powder, for example, into a cool or hot mold and applying a desired pressure. Although the pressure may be suitably selected according to the composition and the like of the mixture, a range of 4 to 20 t/cm$^2$ is preferable in view of handling of the formed product.

After molding, the molded product is sintered to give a desired molded body. The sintering may be carried out, for example, using a vacuum heat treatment furnace, an atmosphere heat treatment furnace, or an inactive gas heat treatment furnace, or the like.

As the conditions of the sintering, a sintering temperature of 1000 to 1400° C. and a sintered time of 30 to 80 minutes are preferable.

EXAMPLES

Hereinafter the present invention is further specifically explained with referring to the Examples, but the invention is not limited to the following Examples unless it exceeds the gist of the invention.

Example 1

Si micropowder A was added to a permalloy PB-based raw material powder (Fe-50Ni-2Si) having an average particle diameter D50 of 150 μm so that Si was adjusted to 3% by mass, and mixed. Further, 0.5% by mass of a zinc stearate was added as a lubricant to the mixed powder under room temperature, and mixed. The obtained mixed powder was put into a mold at room temperature and pressed at a surface pressure of 15 t/cm$^2$ to give a pressed product having a ring shape. The pressed product was sintered at 1300° C. for 60 minutes to give a sintered product, a molded body.

For the obtained sintered product, direct current magnetic property, iron loss and specific resistance were measured as follows. The results of the measurements are shown in the following Table 1.

—1) Direct current magnetic property—

Using a direct current magnetic property testing apparatus (trade name: TYPE SK-130, manufactured by Metron Inc.), the magnetic flux density $B_{2000}$ at the magnetizing force of 2000 A/m, and the maximum relative magnetic permeability μm were measured and used as indices for evaluating the direct current magnetic property.

—2) Iron Loss—

Using a B-H analyzer (trade name: TYPE SY8258, manufactured by Iwatsu Test Instruments Corporation), the magnetic flux density 1 T (tesla, hereinafter the same), loss at 50 Hz, loss at 0.05 T and 5 kHz, and loss at 0.05 T and 10 kHz were measured and used as indices for evaluating the iron loss W [W/kg].

—3) Specific Resistance—

Using a four-terminal four-probe method high precision low resistivity meter (trade name: MCP-T600, manufactured by Mitsubishi Chemical Corporation), specific resistance ρ[μΩ·cm] was measured.

Example 2

A sintered product was obtained by pressing and sintering in a similar manner to Example 1, except that Si micropowder A was replaced with Si micropowder B in Example 1. Furthermore, measurement and evaluation were carried out in a similar manner to Example 1, and the results are shown in the following Table 1.

Example 3

A sintered product was obtained by pressing and sintering in a similar manner to Example 1, except that Si micropowder A was replaced with Si micropowder C in Example 1. Furthermore, measurement and evaluation were carried out in a similar manner to Example 1, and the results are shown in the following Table 1.

Example 4

A sintered product was obtained by pressing and sintering in a similar manner to Example 1, except that Si micropowder A was replaced with Si micropowder D in Example 1. Furthermore, measurement and evaluation were carried out in a similar manner to Example 1, and the results are shown in the following Table 1.

Example 5

Si micropowder A was added to an iron-silicon based raw material powder (Fe-2Si) having an average particle diameter D50 of 150 μm so that Si was adjusted to 3% by mass, and mixed. Further 0.5% by mass of zinc stearate was added as a lubricant to the mixed powder and mixed under room temperature. The obtained mixed powder was put into a mold at room temperature and pressed at a surface pressure of 15 t/cm$^2$ to give a pressed product having a ring shape. The obtained pressed product was sintered at 1300° C. for 60 minutes to give a sintered product, a molded body.

The obtained sintered product was evaluated in a similar manner to Example 1. The results of measurement and evaluation are shown in the following Table 1.

Example 6

A sintered product was obtained by pressing and sintering in a similar manner to Example 5, except that Si micropowder A was replaced with Si micropowder B in Example 5. Furthermore, measurement and evaluation were carried out in a similar manner to Example 1, and the results are shown in the following Table 1.

Example 7

A sintered product was obtained by pressing and sintering in a similar manner to Example 5, except that Si micropowder A was replaced with Si micropowder C in Example 5. Furthermore, measurement and evaluation were carried out in a similar manner to Example 1, and the results are shown in the following Table 1.

Example 8

A sintered product was obtained by pressing and sintering in a similar manner to Example 5, except that Si micropowder A was replaced with Si micropowder D in Example 5. Furthermore, measurement and evaluation were carried out in a similar manner to Example 1, and the results are shown in the following Table 1.

Example 9

A sintered product was obtained by pressing and sintering in a similar manner to Example 1, except that the amount of Si was changed from 3% by mass to 4% by mass in Example 1. Furthermore, measurement and evaluation were carried out in a similar manner to Example 1, and the results are shown in the following Table 1.

Example 10

A sintered product was obtained by pressing and sintering in a similar manner to Example 2, except that the amount of Si was changed from 3% by mass to 4% by mass in Example 2. Furthermore, measurement and evaluation were carried out in a similar manner to Example 1, and the results are shown in the following Table 1.

Example 11

A sintered product was obtained by pressing and sintering in a similar manner to Example 5, except that the amount of Si was changed from 3% by mass to 4% by mass in Example 5. Furthermore, measurement and evaluation were carried out in a similar manner to Example 1, and the results are shown in the following Table 1.

Example 12

A sintered product was obtained by pressing and sintering in a similar manner to Example 6, except that the amount of Si was changed from 3% by mass to 4% by mass in Example 6. Furthermore, measurement and evaluation were carried out in a similar manner to Example 1, and the results are shown in the following Table 1.

Example 13

A sintered product was obtained by pressing and sintering in a similar manner to Example 1, except that the amount of Si was changed from 3% by mass to 6% by mass in Example 1. Furthermore, measurement and evaluation were carried out in a similar manner to Example 1, and the results are shown in the following Table 1.

Example 14

A sintered product was obtained by pressing and sintering in a similar manner to Example 2, except that the amount of Si was changed from 3% by mass to 6% by mass in Example 2. Furthermore, measurement and evaluation were carried out in a similar manner to Example 1, and the results are shown in the following Table 1.

Example 15

A sintered product was obtained by pressing and sintering in a similar manner to Example 5, except that the amount of Si was changed from 3% by mass to 6% by mass in Example 5. Furthermore, measurement and evaluation were carried out in a similar manner to Example 1, and the results are shown in the following Table 1.

Example 16

A sintered product was obtained by pressing and sintering in a similar manner to Example 6, except that the amount of Si was changed from 3% by mass to 6% by mass in Example 6. Furthermore, measurement and evaluation were carried out in a similar manner to Example 1, and the results are shown in the following Table 1.

Example 17

A sintered product was obtained by pressing and sintering in a similar manner to Example 1, except that Si micropowder A was added to a permalloy PB-based raw material powder (Fe-51Ni) having an average particle diameter D50 of 180 μm so that Si was adjusted to 2% by mass, and mixed, and that the sintering temperature was changed from 1300° C. to 1350° C. Furthermore, measurement and evaluation were carried out in a similar manner to Example 1, and the results are shown in the following Table 1.

Example 18

A sintered product was obtained by pressing and sintering in a similar manner to Example 5, except that Si micropowder A was added to an iron-silicon-based raw material powder (Fe-1Si) having an average particle diameter D50 of 130 μm so that Si was adjusted to 2% by mass, and mixed. Furthermore, measurement and evaluation were carried out in a similar manner to Example 1, and the results are shown in the following Table 1.

Example 19

A sintered product was obtained by pressing and sintering in a similar manner to Example 5, except that Si micropowder D was added to an iron-silicon-phosphor-based raw material powder (Fe-1S-0.05P) having an average particle diameter D50 of 150 μm so that Si was adjusted to 3% by mass, and mixed, and that the sintering temperature was changed from 1300° C. to 1250° C.

Furthermore, measurement and evaluation were carried out in a similar manner to Example 1, and the results are shown in the following Table 1.

Example 20

A sintered product was obtained by pressing and sintering in a similar manner to Example 5, except that Si micropowder D was added to an iron-silicon-phosphor-based raw material powder (Fe-2Si-0.05P) having an average particle diameter D50 of 150 μm so that Si was adjusted to 4% by mass, and mixed, and that the sintering temperature was changed from 1300° C. to 1250° C. Furthermore, measurement and evaluation were carried out in a similar manner to Example 1, and the results are shown in the following Table 1.

Comparative Example 1

A conventionally-used an electromagnetic stainless material made of melted metals (Fe-13Cr-2A1-2Si-0.3Pb) was prepared. The result is shown in the following Table 1.

Comparative Example 2

As a conventionally-used sintered electromagnetic stainless material, a sintered electromagnetic stainless material obtained by molding and sintering using a metal powder containing Fe, Cr and Si and having a composition of Fe-9.5Cr-4Si was prepared. The result is shown in the following Table 1.

Comparative Example 3

A mixed powder of Fe-1 Si was prepared by mixing Fe powder and Fe-18Si powder, and the mixed powder was pressed and sintered in a manner similar to Example 1 to give a sintered product. Furthermore, measurement and evaluation were carried out in a manner similar to Example 1, and the results are shown in the following Table 1.

Comparative Example 4

A sintered product was obtained by pressing and sintering in a similar manner to Example 1, except that Si micropowder A was added to a permalloy PB-based raw material powder (Fe-40.8Ni) having an average particle diameter D50 of 150 μm so that Si was adjusted to 2% by mass, and mixed. Furthermore, measurement and evaluation were carried out in a manner similar to Example 1, and the results are shown in the following Table 1.

Comparative Example 5

A sintered product was obtained by pressing and sintering in a similar manner to Example 1, except that Si micropowder A was added to a permalloy PB-based raw material powder (Fe-52.5Ni-1Si) having an average particle diameter D50 of 150 μm so that Si was adjusted to 2% by mass, and mixed. Furthermore, measurement and evaluation were carried out in a manner similar to Example 1, and the results are shown in the following Table 1.

TABLE 1

| | | | | | Direct current magnetic property | | Iron loss [W/kg] | | | |
|---|---|---|---|---|---|---|---|---|---|---|
| | Raw material powder | Si micropowder | Composition | Density [Mg/m$^2$] | Saturated magnetic flux density $B_{2000}$ [T] | Maximum relative magnetic permeability $\mu_m$ [—] | 1.0 T 50 Hz | 0.05 T 5 kHz | 0.05 T 10 kHz | Specific resistance ρ [μΩ · cm] |
| Example 1 | Fe—50Ni—2Si | A | Fe—49.5Ni—3Si | 7.6 | 1.1 | 6200 | 10 | 15 | 52 | 220 |
| Example 2 | Fe—50Ni—2Si | B | Fe—49.5Ni—3Si | 7.7 | 1.1 | 6600 | 10 | 14 | 49 | 220 |
| Example 3 | Fe—50Ni—2Si | C | Fe—49.5Ni—3Si | 7.7 | 1.1 | 6500 | 10 | 14 | 49 | 230 |
| Example 4 | Fe—50Ni—2Si | D | Fe—49.5Ni—3Si | 7.7 | 1.1 | 6700 | 10 | 14 | 50 | 230 |
| Example 5 | Fe—2Si | A | Fe—3Si | 7.4 | 1.4 | 5700 | 12 | 24 | 75 | 170 |
| Example 6 | Fe—2Si | B | Fe—3Si | 7.4 | 1.4 | 5200 | 12 | 24 | 75 | 180 |

TABLE 1-continued

| | Raw material powder | Si micropowder | Composition | Density [Mg/m$^2$] | Direct current magnetic property: Saturated magnetic flux density $B_{2000}$ [T] | Direct current magnetic property: Maximum relative magnetic permeability $\mu_m$ [—] | Iron loss [W/kg] 1.0 T 50 Hz | Iron loss [W/kg] 0.05 T 5 kHz | Iron loss [W/kg] 0.05 T 10 kHz | Specific resistance ρ [μΩ · cm] |
|---|---|---|---|---|---|---|---|---|---|---|
| Example 7 | Fe—2Si | C | Fe—3Si | 7.5 | 1.4 | 5800 | 12 | 24 | 74 | 160 |
| Example 8 | Fe—2Si | D | Fe—3Si | 7.5 | 1.4 | 5600 | 12 | 24 | 75 | 170 |
| Example 9 | Fe—50Ni—2Si | A | Fe—49.0Ni—4Si | 7.4 | 0.9 | 8700 | 14 | 18 | 69 | 240 |
| Example 10 | Fe—50Ni—2Si | B | Fe—49.0Ni—4Si | 7.5 | 1.0 | 9900 | 12 | 16 | 53 | 250 |
| Example 11 | Fe—2Si | A | Fe—4Si | 7.1 | 1.2 | 3800 | 11 | 22 | 67 | 200 |
| Example 12 | Fe—2Si | B | Fe—4Si | 7.2 | 1.2 | 4100 | 12 | 22 | 65 | 210 |
| Example 13 | Fe—50Ni—2Si | A | Fe—48.0Ni—6Si | 7.2 | 0.5 | 800 | — | 30 | 91 | 260 |
| Example 14 | Fe—50Ni—2Si | B | Fe—48.0Ni—6Si | 7.3 | 0.6 | 950 | — | 24 | 72 | 320 |
| Example 15 | Fe—2Si | A | Fe—6Si | 6.9 | 1.1 | 3200 | 11 | 28 | 82 | 270 |
| Example 16 | Fe—2Si | B | Fe—6Si | 6.9 | 1.2 | 4500 | 10 | 25 | 72 | 310 |
| Example 17 | Fe—51Ni | A | Fe—50Ni—2Si | 7.8 | 1.3 | 8800 | 14 | 14 | 50 | 190 |
| Example 18 | Fe—1Si | A | Fe—2Si | 7.5 | 1.5 | 5600 | 13 | 24 | 73 | 160 |
| Example 19 | Fe—1Si—0.05P | D | Fe—3Si—0.049P | 7.6 | 1.6 | 6500 | 11 | 22 | 70 | 170 |
| Example 20 | Fe—2Si—0.05P | D | Fe—4Si—0.049P | 7.3 | 1.4 | 4500 | 12 | 20 | 60 | 200 |
| Comparative Example 1 | Electromagnetic stainless material made of melted metals | Fe—13Cr—2Al—2Si—0.3Pb | | 7.6 | 1.4 | 3000 | 13 | 47 | 136 | 72 |
| Comparative Example 2 | Sintered electromagnetic stainless | Fe—9.5Cr—4Si | | 7.3 | 1.2 | 2700 | 10 | 22 | 61 | 100 |
| Comparative Example 3 | Fe—18Si + 100Fe | Fe—1Si | | 7.6 | 1.5 | 5000 | — | — | — | 110 |
| Comparative Example 4 | Fe—40.8Ni | A | Fe—40Ni—2Si | 7.6 | 0.9 | 500 | 35 | 67 | 100 | 90 |
| Comparative Example 5 | Fe—52.5Ni—1Si | A | Fe—52Ni—2Si | 7.6 | 0.8 | 4000 | 30 | 60 | 90 | 100 |

The specifics of Si micropowders A to D shown in the Table 1 are as follows.

A: Si powder, average particle diameter D50: 12 μm

B: Si powder, average particle diameter D50: 1.6 μm

C: Si powder, average particle diameter D50: 8.2 μm

D: Si powder, average particle diameter D50: 6.8 μm

Figure 1B:
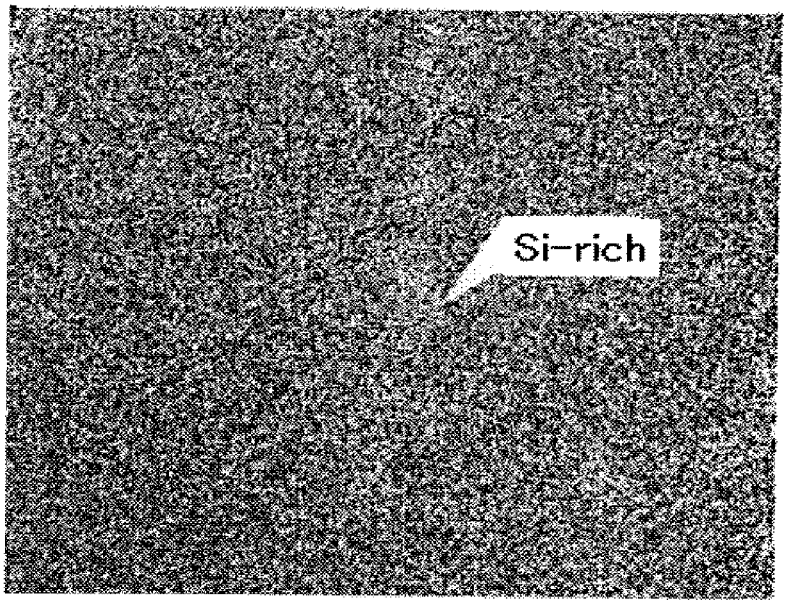
FIG. 1B is a SEM picture showing the second electron image of Si in the inner structure of the sintered product of Example 1.

From the results of the Table 1 and FIGS. 1A and 1B, the followings are evident.

(1) In Examples 1 to 20, the specific resistance was about twice or more and the iron loss was significantly decreased, as compared to Comparative Examples 1 and 2, conventional materials.

Furthermore, in Examples 1 to 20, the specific resistance was twice or more as compared to the specific resistance 60 to 80 μΩ·cm of the conventionally-used electromagnetic steel plate, which was made of melted metals, in which Si (3 to 6.5% by mass) was evenly dispersed, which shows the effect of increasing in the specific resistance by Si-rich among the particles.

(2) As is apparent from Examples 1 to 4, 5 to 8, 9 to 10, 11 and 12, when the Si micropowder having an average particle diameter of about from 1/10 to 1/100 of the raw material powder was mixed, similar properties were obtained irrespective of the average particle diameter of the Si micropowder.

(3) With respect to the range of the amount of Si, the following may be considered.

From Comparative Example 3, when Si is 1% by mass, the specific resistance is 110 μΩ·m, which is similar to that of the conventional materials (Comparative Examples 1 and 2), and any effect may not be obtained. In Examples 13 to 16 in which Si was 6% by mass, molding property was deteriorated and density and saturated magnetic flux density also tended to be decreased as compared to other examples, which was a limitation as an extent. Therefore, it is suitable that Si is 2 to 6% by mass.

(4) As shown in FIGS. 1A and 1B, it is apparent that the Si component is concentrated among vicinity the particles in the metal powder in the Examples.

The entire disclosure of Japanese Patent Application No. 2007-134488 is incorporated herein into this specification by reference.

All documents, patent applications and technical specifications recited in this specification are incorporated herein by reference in this specification to the same extent as if each individual publication, patent applications and technical standard was specifically and individually indicated to be incorporated by reference.

The invention claimed is:

1. A sintered soft magnetic powder molded body comprising a particulate composition containing Fe, 44% to 50% by mass of Ni, 2% to 6% by mass of Si, and impurities, wherein the Si is unevenly distributed among particles of the composition.

2. The sintered soft magnetic powder molded body according to claim 1, wherein the composition comprises a metal powder comprising at least Fe and Ni mixed with an Si powder having an average particle diameter of from 1/10 to 1/100 of an average particle diameter of the metal powder, and wherein the composition is molded and sintered.

3. The sintered soft magnetic powder molded body according to claim 2, wherein the metal powder comprises Fe, 44% to 53.2% by mass of Ni, less than 6% by mass of Si, and impurities.

4. A sintered soft magnetic powder molded body comprising a particulate composition containing Fe, 2% to 6% by mass of Si, and impurities, wherein the Si is unevenly distributed among particles of the composition.

5. The sintered soft magnetic powder molded body according to claim 4, which further comprises 0.001% to 0.1% by mass of P.

6. The sintered soft magnetic powder molded body according to claim 4, wherein the composition comprises a metal powder containing at least Fe mixed with an Si powder having an average particle diameter of from 1/10 to 1/100 of an average particle diameter of the metal powder, and wherein the composition is molded and sintered.

7. The sintered soft magnetic powder molded body according to claim 6, wherein the metal powder comprises 94% to 100% by mass of Fe, and less than 6% by mass of Si.

8. The sintered soft magnetic powder molded body according to claim 7, wherein the metal powder further comprises 0.001% to 0.1% by mass of P.

9. The sintered soft magnetic powder molded body according to claim 1, wherein the concentration of Si among the particles is higher than the concentration of Si other than among the particles.

10. The sintered soft magnetic powder molded body according to claim 2, wherein the metal powder is an atomized powder.

11. The sintered soft magnetic powder molded body according to claim 1, wherein the Ni content is 48 to 50% by mass and the Si content is 3 to 4% by mass.

12. The sintered soft magnetic powder molded body according to claim 4, wherein the Si content is 3% to 4% by mass.

13. The sintered soft magnetic powder molded body according to claim 2, wherein the average particle diameter (D50) of the metal powder is from 1 μm to 300 μm.

14. The sintered soft magnetic powder molded body according to claim 10, wherein the atomized powder is a water-atomized powder.

15. The sintered soft magnetic powder molded body according to claim 5, wherein the composition comprises a metal powder containing at least Fe mixed with an Si powder having an average particle diameter of from 1/10 to 1/100 of an average particle diameter of the metal powder, and wherein the composition is molded and sintered.

16. The sintered soft magnetic powder molded body according to claim 15, wherein the metal powder comprises 94% to 100% by mass of Fe, less than 6% by mass of Si.

17. The sintered soft magnetic powder molded body according to claim 16, wherein he metal powder further comprises 0.001% to 0.1% by mass of P.

18. The sintered soft magnetic powder molded body according to claim 4, wherein the concentration of Si among the particles is higher than the concentration of Si other than among the particles.

19. The sintered soft magnetic powder molded body according to claim 6, wherein the metal powder is an atomized powder.

20. The sintered soft magnetic powder molded body according to claim 6, wherein the average particle diameter (D50) of the metal powder is from 1 μm to 300 μm.

* * * * *